US006354469B1

(12) United States Patent
Pozzi

(10) Patent No.: US 6,354,469 B1
(45) Date of Patent: Mar. 12, 2002

(54) DEVICE FOR PACKAGING AND DISPENSING A PRODUCT, WITH MANUAL PUMP AND AN AIR INTAKE FILTER

(75) Inventor: Jacques Pozzi, Antibes (FR)

(73) Assignee: Sivel (FR)

( * ) Notice: Subject to any disclaimer, the term of this patent is extended or adjusted under 35 U.S.C. 154(b) by 0 days.

(21) Appl. No.: 09/581,275

(22) PCT Filed: Dec. 7, 1998

(86) PCT No.: PCT/FR98/02640

§ 371 Date: Sep. 1, 2000

§ 102(e) Date: Sep. 1, 2000

(87) PCT Pub. No.: WO99/29433

PCT Pub. Date: Jun. 17, 1999

(30) Foreign Application Priority Data

Dec. 8, 1997 (FR) ..... 97 15469

(51) Int. Cl.[7] ..... B67D 5/58
(52) U.S. Cl. ..... 222/189.09; 222/321.9
(58) Field of Search ..... 222/189.06, 184.09, 222/321.5, 321.7, 321.9, 380, 464.7

(56) References Cited

U.S. PATENT DOCUMENTS 4,470,526 A * 9/1984 Cha et al. ..... 222/321.5
5,174,476 A * 12/1992 Steiner et al. ..... 222/189.09
5,366,119 A * 11/1994 Kline ..... 222/321.5
5,829,645 A * 11/1998 Hennemann ..... 222/189.09
6,073,812 A * 6/2000 Wade et al. ..... 222/189.09

FOREIGN PATENT DOCUMENTS

WO 9009568 * 8/1990 ..... 222/464.7

* cited by examiner

*Primary Examiner*—Joseph A. Kaufman
(74) *Attorney, Agent, or Firm*—Piper Marbury Rudnick & Wolfe

(57) ABSTRACT

The device comprises a rigid container, a manual pump mounted on the container for dispensing in unit doses the product contained in the container and a filter for filtering outside air entering the container when the pump is actuated. The pump has no air intake in the container and the filter is arranged in an air intake passage provided in the base of the container, which is injection-moulded. The invention is useful for packaging and dispensing of fluids, in particular liquids, which need to be maintained germ-free.

17 Claims, 5 Drawing Sheets

DEVICE FOR PACKAGING AND DISPENSING A PRODUCT, WITH MANUAL PUMP AND AN AIR INTAKE FILTER

FIELD OF THE INVENTION

The present invention relates to the technical area of packaging, and more precisely the area of packaging a fluid product, in general liquid but which can also be in paste or gel form. The packaged product is intended to be kept germ-free without addition of a preservative, to be protected from oxidation, or to be sheltered from all external pollution, although in contact with the air, and also intended to be dispensed in unit doses by means of a manual pump.

More particularly, the object of the invention is a device for packaging and dispensing a product in unit doses. The device includes a container that is able to contain the product to be dispensed in unit doses by means of a manual pump, of the type without an air intake, which is mounted on the container while tightly sealing an opening in the container, for example, the open neck of a flask.

BACKGROUND OF THE INVENTION

Packaging and dispensing devices of conventional structure are known to comprise a container on which is fitted a manual pump for dispensing the product contained in the container. The pump generally includes a plunger which allows a piston to be moved by simple finger pressure in a pumping chamber, the volume of which determines the dose of the product to be dispensed. A first valve allows the chamber to be isolated from the internal volume of the container when the product is expelled from the chamber through a second valve. As a result of the movement of the piston caused by pressure on the plunger, the second valve allows the chamber to be isolated from the outside. When this chamber is filled via the first valve with a dose of the product coming from inside of the container, the dose is drawn into the chamber by the return of the piston towards its initial position. The dose of the product rests on a stop forming part of the pump body enclosing the pumping chamber, wherein the piston is caused to slide by elastic return means.

Thus, each time the piston returns to its starting position, reached by the effect of elastic return means, such as a spring, a dose of product is drawn into the pump chamber.

This suction of the product causes a partial vacuum inside the container.

For this reason, it is necessary to admit air from the outside into the container. This admission of air is generally provided through the pump.

The major disadvantage of this type of device lies in the fact that the admission of outside air to the interior of the container does not allow the product contained in the container to be kept sterile, to be protected from oxidation, or from all external pollution.

To remedy this disadvantage, different types of devices are proposed. For example, a device that comprises a pump without an air intake and a deformable container which contains the product to be packaged and dispensed by the pump has been proposed. The deformable container is an internal container around which a rigid external container is provided to ensure the mechanical protection of the deformable internal container. Each time a dose of the product is expelled from the deformable container, the partial vacuum created in the container causes contraction of the deformable container. In order for a device with a double container to function, it is necessary that the deformable internal container is able to retract.

For this reason, it is necessary to allow outside air to enter the space enclosed between the deformable internal container and the rigid external container.

This air intake can be provided near the neck of the container or at a passage at the bottom of the rigid container.

Further devices include an outside air intake circuit through the pump, which is fitted with a closing system which allows outside air to enter the space between the two containers when the pump is actuated. The closing system prevents vapors from the product, which have passed through the wall of the deformable container and are present in the space between the two containers, from escaping from this space to the outside when the pump is not being actuated.

A disadvantage of this type of device lies in the fact that it requires the use of a pumps including an air intake circuit, distinct from the product outlet circuit, and a closing system for the air intake circuit. Such a pump has a complex structure comprising a large number of parts that are intricate and difficult to fabricate.

Another disadvantage lies in the fact that when the deformable container has begun to retract it tends, through its own elasticity, to return to its starting position, thereby creating a partial vacuum within the product it encloses.

A consequence of this partial vacuum, principally when the product is a liquid or a fluid, and in particular a paste or a gel, is the appearance of a cavitation phenomenon leading to the formation of bubbles which impair the precision of the dosage.

Another type of a known device comprises a conventional container with a single rigid wall on which is fitted a pump with an air intake circuit. The air intake circuit includes a filter for sterilizing or absorbing the oxygen from the air, for keeping the product sterile, for protecting it from oxidation and for protecting the product from any external pollution.

In such a device, for example, FR-A-2 669 379, the outside air enters the container to compensate for the partial vacuum created by each action on the pump . This causes a dose of the product to be released such that it is filtered in a sterile manner.

The sterility of the product in the container is not, therefore, affected by contact with air coming from the outside. This is advantageous for the packaging and dispensing of pharmaceutical products.

The major disadvantage of this type of packaging device is the need to use a special pump, including a filter. The addition of the filter to the pump is a delicate and onerous operation, as it requires substantial structural modification to known pumps.

Packaging devices of this last type have been described, notably in FR-A-2 669 379, but, to the knowledge of the Applicant, none has been commercialized up to now.

A first objective of the invention is to propose a device for packaging and dispensing a product with a conventional container, a manual pump and a filter, which allows the use of standard dosing pumps that are available at low cost on the market.

Another objective of the invention is to propose such a device in which the creation of a partial vacuum inside a generally liquid product, paste or gel, is avoided, in order not to distort the dosage.

More generally, the objective of the invention is to remedy the disadvantages of similar devices representing the state of the art, and to propose such a device which meets the various practical demands better than known devices.

SUMMARY OF THE INVENTION

A device for packaging and dispensing a fluid product, which is generally liquid but may be, a paste or a gel. The packaging and dispensing device includes a container with a single rigid wall for containing the product to be packaged and dispensed, a manual pump mounted on the container for dispensing the product in unit doses, and a filter for filtering outside air entering the container when the pump is actuated. The pump has no air intake in the container and the filter is arranged in an air intake passage provided in the base of the container, which is injection-molded in a synthetic material.

Outside air can pass through the air intake passage and the filter, which is preferably sterile, and can compensate the partial vacuum created in the container when the user operates the pump.

The container is advantageously formed of two parts, a neck and a body. The neck has an open mouth on which the pump is mounted in a tightly sealing manner. The body with a base including the air intake passage which accommodates the filter, the two parts being injection-molded separately and then assembled in a sealed manner.

In a first, advantageously simple embodiment, the filter is mounted in a rigid sheath, preferably made of plastic and closely fitted to the filter. The outer shape of the sheath matches the part of the air intake passage in which the sheath is fixed by any appropriate means, such as pressure fitting, ultrasonic welding or snap-fitting.

Since sterile filters allow both gases and liquids to pass, a filter made of a hydrophobic filtering material will advantageously be chosen when the product to be packaged and dispensed is of an aqueous nature. A filter made of an absorbent filtering material will be chosen when the product for packaging and dispensing is of a non-aqueous nature.

Thus, when the product for packaging and dispensing is of an aqueous nature, the hydrophobic filter admits outside air but repels the product, which cannot escape to the outside thereby avoiding any risk of leakage. When the product for packaging and dispensing is of a non-aqueous nature, the absorbent filter admits outside air but repels the product which cannot escape to the outside.

In a variant, the device comprises a valve arranged between the filter and the internal space of the container for preventing any escape of the product contained in the container through the air intake passage and to avoid any contact between the product and the filter.

Advantageously, the valve is elastically deformable and cooperates with a conical seat, on the end, which is turned towards the inside of the container of a shaft formed integral with the base and defining the air intake passage in which the filter is retained. Such an elastic valve can efficiently oppose any escape of product to the outside of the container through the air intake passage, while admitting outside air by flexing elastically towards the inside of the container under the effect of the suction of outside air during the phase of pumping a dose of product from the internal space of the container.

Advantageously, the elastic valve is retained by a plug on the end of the shaft facing towards the inside of the container. In this case, the air intake passage may include grooves provided in the conical seat and the wall of an orifice in which the plug fixing the valve on the shaft is retained.

In these different variants, it is always advantageous for the filter, with its sheath if applicable, to be mounted in a conical central part of a shaft formed in one piece with the base of the container.

If it is desired to facilitate the injection-molding of the body of the container, starting from a central point in its base, it is advantageous that the conical central part of the shaft be closed towards the outside of the container by a base in which a hole for the air intake passage is provided eccentrically.

In another variant, which allows the maximum of the product contained in the container to be dispensed, the air intake passage opens to the inside of the container in the central part of a conical base of the container. The base widens towards the inside of the container permitting an optimum emptying of the container.

As the body of the container, like its neck, if applicable, is made of plastic using injection techniques, a perfect geometry can be advantageously obtained for the part of the air intake passage in which the filter is housed, for the conical seat on which the elastic valve is fitted and for other structural characteristics such as the grooves in the air intake passage.

With the objective of simplifying the manufacture of the filter, especially when it is sterile, commercial filters normally used in conjunction with a syringe and a needle can be used. These commercial filters are housed in a plastic sheath including a conical female part for assembling with the conical male outlet of the syringe and a conical male part for assembling with the conical female part of the needle. For this reason, it is advantageously proposed that the air intake passage includes a female conical part in which the male conical part of the filter sheath is assembled, if applicable, by a simple snap fit.

Other characteristics and advantages of the invention can be seen from the description given below, with reference to the attached drawings, which show, by way of non-limiting examples, embodiments of the construction and use of the object of the invention.

DETAILED DESCRIPTION OF THE INVENTION

Figure 1:
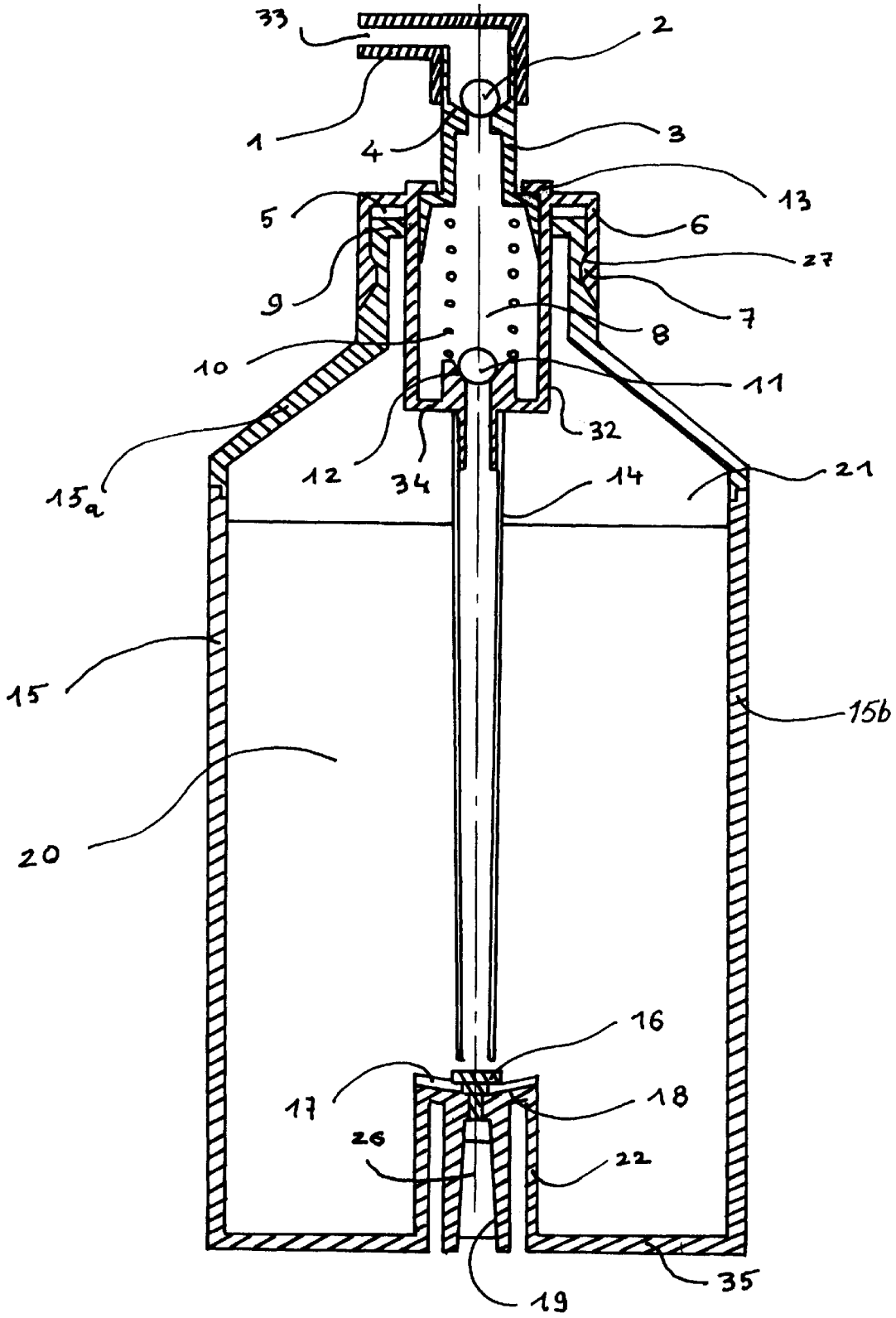
FIG. 1 is a schematic view in axial section of a first example of a device according to the invention, comprising a container made in two parts assembled together in a sealed manner, and cooperating with a manual pump for dispensing unit doses, a filter and a valve for protection of the filter against leakage of the product through the air intake passage.
Figure 2:
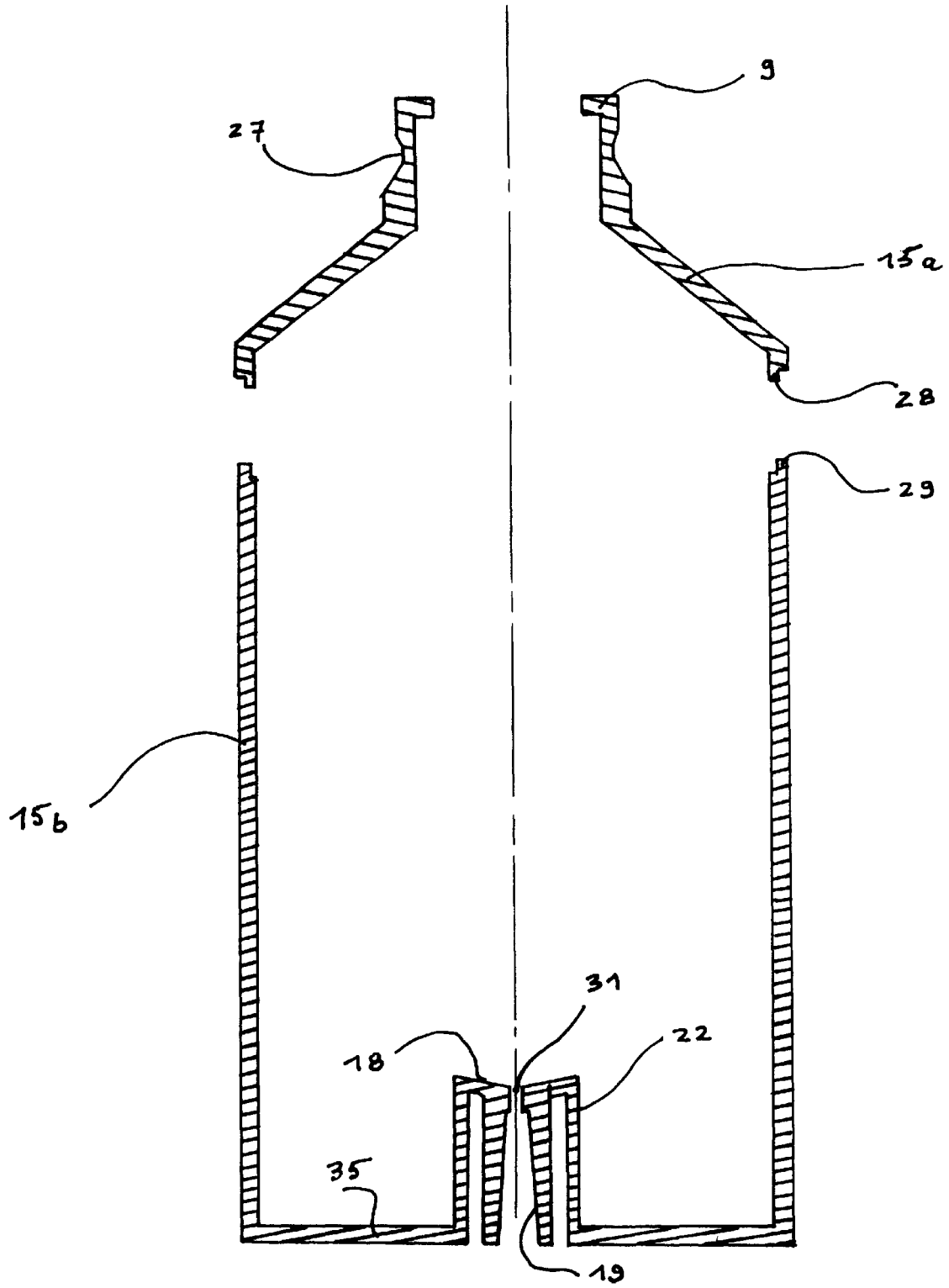
FIG. 2 a is view in axial section of the two parts of the container before assembly.

As shown in FIGS. 1 and 2, the device for packaging and dispensing a product, for example a liquid, in unit doses comprises a container 15 with a single rigid wall formed in two parts, namely a body 15*b*, of generally cylindrical form, closed by a base and open in its upper part, and a neck 15*a*, of generally cylindrical-conical form tapering inwards towards the top, and joined in a sealed manner to the body 15*b*. A dosing pump 13, of a type without an air intake and of known general structure and operation, is mounted in a sealed manner on the open mouth 9 of the neck 15*a*. A filter 26 for purifying the outside air entering the container 15 and of a sterile type is mounted in the conical part 19 of a central shaft 22 enclosing an intake passage for admitting outside air to the container 15, and located in the base 35 of the body 15*b*, a valve 17 being mounted on the end of the shaft 22 facing towards the inside of the container 15. This valve 17 protects the filter 26 from the product contained in the container 15 and prevents any leakage of this product from the container 15 through the air intake passage.

The pump 13 comprises a body 32 having a cylindrical central part, in which slides a piston 3 having a central shaft by which the piston 3 is attached to a plunger 1 through which passes a dispensing passage 33. A first valve 11, with a sealing ball, operates in conjunction with a tapered seat 12 around a central opening in the base 34 of the cylindrical central part of the pump body 32, to isolate the pumping chamber 8, enclosed in this body 32 between the piston 3 and the base 34 of this body 32, from the internal volume 20 of the container 15. A second valve 2, also with a sealing ball, cooperates with a seat 4, also tapered, around the central opening in the shaft of piston 3 so as to isolate the pumping chamber 8 from the outside through the dispensing passage 33 in the plunger 1. A helical compression spring 10, extending inside the pumping chamber 8 between the lower part of the piston 3 and the base 34 of the pump body 32 returns the piston 3 to its rest position, against a stop projecting radially from the inside of the cylindrical part of the pump body 32. In this rest position, the two valves 2 and 11 are closed and the pumping chamber 8 has its maximum volume. A plunger tube 14, assembled by press fitting around a small sleeve on the lower part of the pump body 32, allows the product to pass from the inside space 20 of the container 15, close to the base of the latter, towards the inside of the chamber 8 when the valve 11 is open.

The central cylindrical part of the pump body 32 is engaged inside the open mouth 9 of the container 15. An annular sealing gasket 5 is fitted around the pump body 32 and between a flanged shoulder 6 of the pump body 32 and the mouth 9 of the neck 15*a* to ensure a sealed fit between the pump body 32 and the mouth 9. In addition, the flanged shoulder 6 of the pump body 32 has a step 7 projecting towards the inside of the pump body 32. The flanged shoulder 6 allows the pump 33 to be attached to the container 15 by snap-fitting the step 7 of the pump body 32 into a corresponding peripheral groove 27 provided in the outside face of the mouth 9 of the neck 15*a* of the container.

The central shaft 22, located at the center of the base 35 of the container body 15*b* with which the shaft 22 is formed in one piece, includes a tapered central female part 19 enclosing the air intake passage and in which the filter 26, of the sterile type, is retained by press fitting or by any other assembly means such as ultrasonic welding. The shaft 22 has a double wall in this example, and comprises an outer wall surrounding its conical female part 19. The lower end is formed in one piece with the base 35 of the body 15*b*, while the upper end faces towards the inside of the space 20 and is formed in one piece with its conical female part 19. The shaft 22 also has, on its upper end facing towards the inside of the space 20, a tapered face 18, which is very flared and widens towards the inside of the space 20. The tapered face constitutes a seat against which the valve 17, which has an elastically deformable membrane and has the form of a flat annular disc held on the shaft 22 by a plug 16, bears in the closed position. This plug 16 has an enlarged head bearing on the face of valve 17 facing towards the inside of the space 20. The plug also has a stem passing through the central opening in the annular valve 17 and firmly attached to the shaft 22 by press fitting of the stem of the plug 16 into an orifice in the shaft 22. The orifice forms part of the boundary of the air intake passage, since this passage is never totally blocked by the plug 16, so that outside air can always enter the inside space 20 of the container 15 by passing through the filter 26 in the shaft 22 when the valve 17 is lifted from its seat 18 by a partial vacuum in the space 20 following an actuation of the pump.

Figure 3:
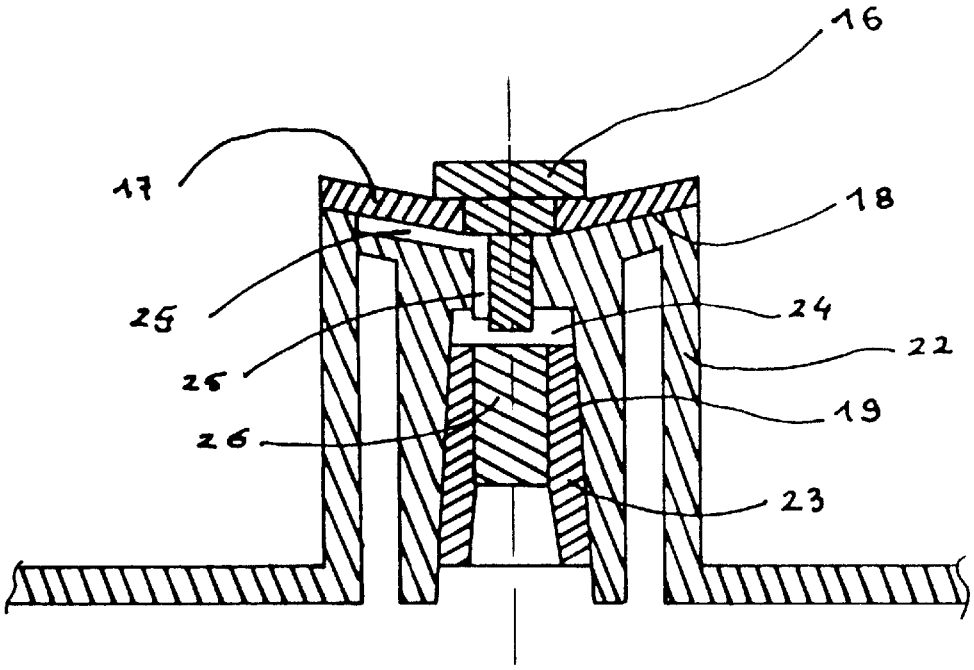
FIG. 3 is an enlarged partial view in axial section showing the air passage with the filter and the valve, in the rest position, in the base of the container in a variant of the device in FIG. 1.
Figure 4:
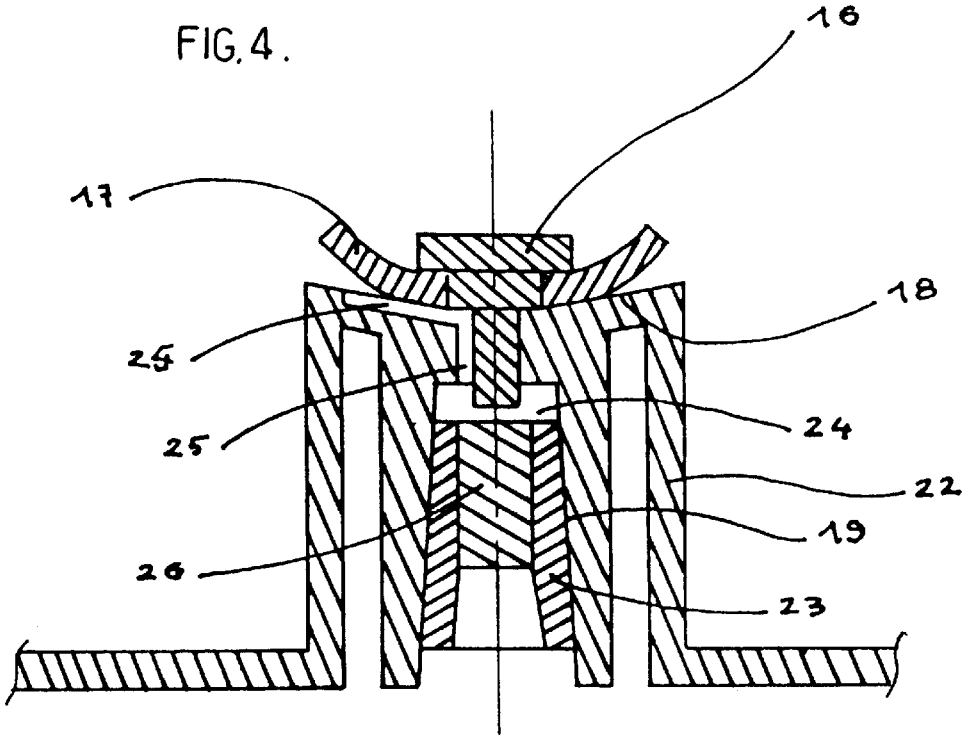
FIG. 4 is a view analogous to FIG. 3, in which the valve is shown in the open position admitting outside air.

The assembly of the filter 26 and the valve 17 is shown in more detail in FIGS. 3 and 4, which show a variant in which the filter 26 is retained inside the central passage of a tubular sheath 23 , the outer shape of which can advantageously be tapered so as to be able to fit snugly into the conical female part 19 of the shaft 22. A free space 24 remains between the top of the filter 26 and its sheath 23 and the underside of the central upper part of the shaft 22 which includes the seat 18. Grooves 25 are provided in this central upper part of the shaft 22 to allow communication between the free space 24 and the face of the valve 17 located on the side of its seat 18 on the shaft 22. The plug 16, the lower part or stem of which is fixed firmly into the central upper part of the shaft 22 by press fitting in an axial orifice in this part which is adjacent to an axial groove 25, has its upper part or head enlarged in the form of a disc enabling it to retain the central part of the valve 17 and forming a sealed joint in the rest position. The plug allows the peripheral part of the valve 17, with elastic membrane, to lift to allow outside air to enter the container 15 to compensate a partial vacuum created in the container 15 when the user operates the pump 13.

In FIGS. 3 and 4 the sheath 23 surrounding the filter 26 can be press-fitted into the conical part 19 of the shaft 22. The geometrical form of which substantially matches the outer form of the sheath 23, which is made of rigid plastic material and may also be welded ultrasonically into the shaft 22. The sheath 23 may also be held in the shaft 22 by elastic snap-fitting of a peripheral snap ring on the sheath 23 into a matching groove in the conical part 19 of the shaft 22.

As the body of the container 15*b* is made of plastic using injection techniques and is assembled in a sealed way on to the neck 15*a*, also made of injected plastic, by ultrasonic welding or by any other appropriate assembly technique producing a sealed joint, an excellent geometry can be obtained for all the parts of the central shaft 22, which is injection-molded with the body of the container 15*b*. In particular an excellent geometry can be obtained for the conical seat 18 on which the elastic valve 17 bears and for the conical part 19 in which the filter 26 is housed surrounded by its conical sheath 23, if applicable.

The device operates in the following manner: manual pressure exerted by the user on the plunger 1 moves the piston 3 against the spring 10 towards the base 34 of the pump body 32 thereby creating an overpressure in chamber 8. This overpressure lifts the valve 2 permitting the product contained in the chamber 8 to escape to the outside by passing through the central shaft in piston 3 and then through the passage 33 in the plunger 1, while the valve 11 is simultaneously closed, preventing any return of product contained in the chamber 8 towards the inside 20 of the container 15. A dose of product is thus dispensed to the outside.

When the manual pressure on the plunger 1 is no longer exerted, the spring 10 returns the piston 3 to its initial rest position resting against the stop in the pump body 32 thereby creating a partial vacuum in chamber 8. This partial vacuum closes the upper valve 2 preventing any outside air from entering the chamber 8, and simultaneously opens the lower valve 11 allowing a new dose of product to enter the chamber 8 from the internal space 20 of the container 15.

This induction of the product from the space 20 creates a partial vacuum inside space 20. It is necessary to allow air to enter from the outside to compensate this partial vacuum.

Under the suction effect produced by the rising of the piston 3 in the pump body 32, outside air enters the interior space 20 of the container 15 after successively passing through the filter 26, the free space 24 and the grooves 25 (see FIGS. 3 and 4), and after having lifted the peripheral part of the elastic valve 17, as shown in FIG. 4.

When the partial vacuum created inside the space 20 is fully compensated by the air entering from outside, the suction ceases and the outside air no longer enters the container 15 through the filter 26. Lifting the valve 17 which, through its inherent elasticity, comes into contact with the conical seat 18 of the shaft 22, prevents the product in the space 20 from coming into contact with the filter 26 and prevents any leakage of product to the outside.

FIG. 2 illustrates the neck 15*a* and the body 15*b* which form the container 15 after sealed assembly. The neck 15*a* is a plastic part of a circular section of the profile of which allows injection-molding, so that extremely precise manufacture can be achieved. This enables very precise forming of the mouth 9 on which the sealing gasket 5 bears, the groove 27 for engaging with the matching step 7 in the pump body 32 as well as the wider part of the neck 15*b*, the diameter of which matches that of the corresponding part of the body 15*b*. The neck 15*a* is assembled to the body 15*b* by means of ultrasonic welding, for example. On this part of the neck 15*a* a circular step 28 allows the ultrasound to focus better by acting as an energy guide. The body 15*b* is also a part of circular section produced by injection-molding with the same plastic as the neck 15*a*, so that it can be easily assembled with the neck 15*a* by ultrasound. A circular step 29, also acting as an energy guide, is formed in the body 15*b* opposite the step 28 in the neck 15*a*, allowing easy and watertight welding between the neck 15*a* and the body 15*b*.

In the base 35 of the body 15*b* the simple shape of the shaft 22 also allows injection-molding, and therefore allows precise forming of the tapered inside face of the conical part 19 of the shaft 22, for assembly by interlocking or by any other means, such as ultrasonic welding. The shape of the shaft also allows for precise forming of the sheath 23 of the filter 26, of the orifice 31 (FIG. 2) for assembly by press-fitting to the plug 16, of the grooves 25 (FIGS. 3 and 4) and of the conical seat 18 on which the lower face of the elastic valve 17 rests.

The design of the container 15 in two parts 15*a* and 15*b* can be formed in plastic, such as polypropylene, for example, by injection-molding, allows the goal of the invention to be achieved. More specifically the part 19 of the shaft 22 of the container 15 in which the filter 26 is housed, the part of the shaft 22 of the container which forms the seat 18 on which the valve 17 is located and the orifice 31 in which the plug 16 for holding the valve 17 is inserted while leaving an air passage are precisely formed.

Figure 5:
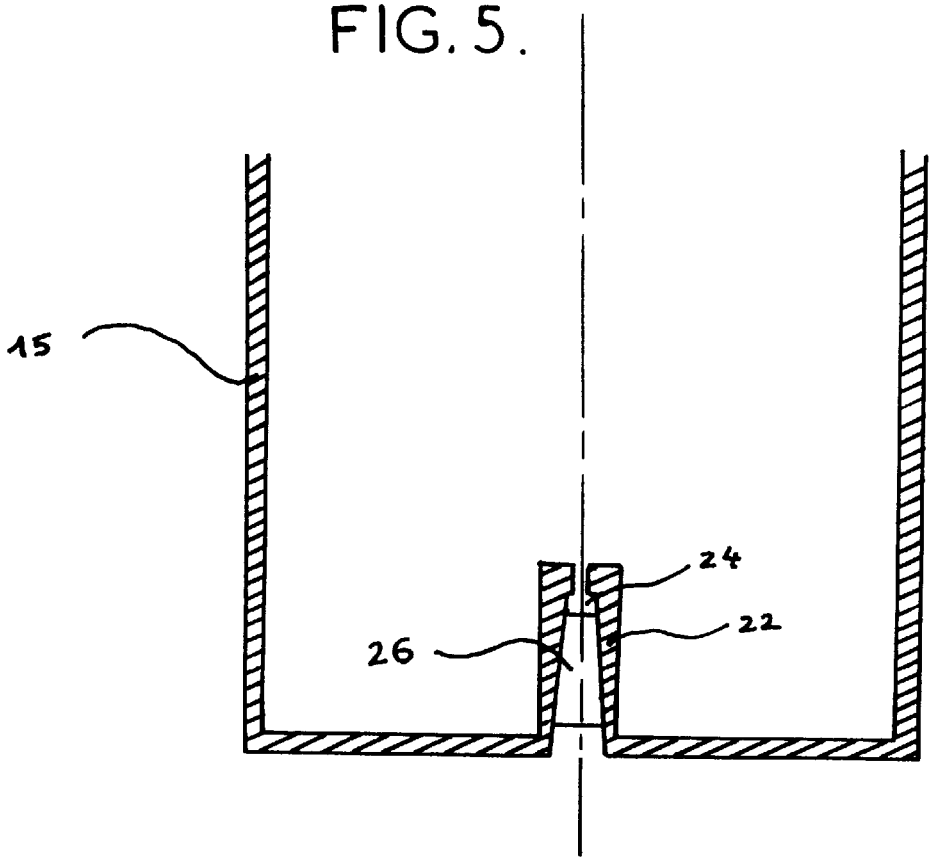
FIG. 5 is a view in axial section of the base of the body of a variant of the container in which an air passage is provided which has a housing for receiving a filter.

In the variant in FIG. 5, the shaft 22, with a single wall and integrated by its lower end with the base of the container 15, still has a tapered central passage narrowing towards the inside of the container 15. The tapered central passage can receive the filter 26, if applicable, without the sheath 23 in FIGS. 3 and 4, but no valve is fitted to the shaft 22. In this structure, still more simple to produce, the sterile filter 26 can be of the hydrophobic type when an aqueous product is packaged in the container 15 or an absorbent filter in the opposite case.

Figure 6:
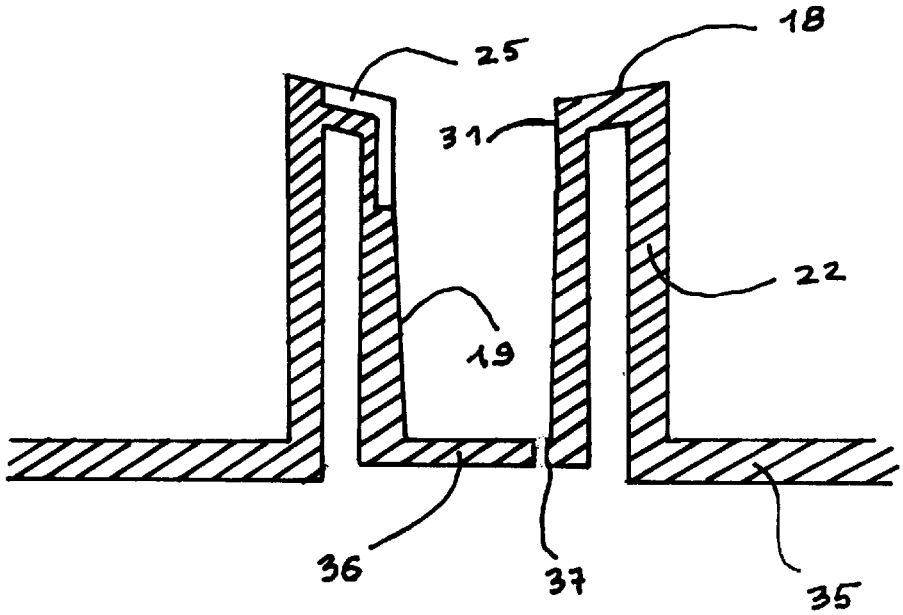
FIG. 6 is an enlarged view in a partial section showing another variant of the base of the container body.

FIG. 6 shows another variant of the base 35 of the container and of the central part of the shaft 22 of the outside air intake. In this embodiments the shaft 22 has a double wall and is still integrated with the base 35 by the lower end of its outer wall. The shaft 22 includes a base 36 forming part of its wall or an internally conical central part 19, for receiving the filter and, in this example, widening towards the inside of the container 15 and no longer towards the outside of the container, as shown in the other embodiments. To allow outside air to enter the container, an eccentric hole 37 is provided in the central part of the base 26 and, although not shown in FIG. 6, an elastic valve may be fixed to the top of the shaft 22, so as to cooperate with the tapered seat 18 in which, as in the example in FIGS. 3 and 4, at least one groove 25 forming an air passage is provided and is extended into the inside face of the conical central part 19.

The advantage of this embodiment lies in the possibility of injecting the plastic into the center of the base 36 when producing the body 15*b* thereby allowing a better dispensing of the material and the production of a part which is almost perfectly cylindrical.

Figure 7:
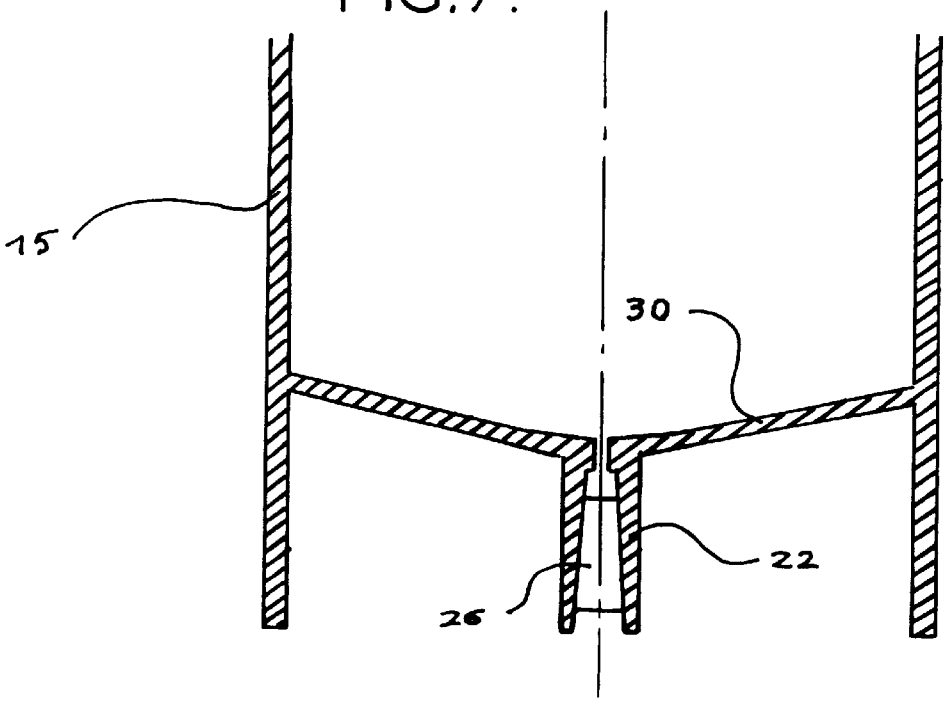
FIG. 7 is a view analogous to FIG. 5 of yet another variant of the base of the container body, with an air intake passage in a conical base allowing the totality of the product contained in the container to be dispensed.

In FIG. 7 the flat base 35 of the container 15 in the examples described previously has been replaced by a conical base 30. The conical base allows more of the product to be dispensed at the end of use than when the base is flat. In particular, the conical base 30 narrows towards the bottom and the outside of the container 15 through its central part that is formed in one piece with the upper end of the central shaft 22. The central shaft 22 has a single wall and a tapered central passage to house the filter 26 in the air intake passage passing through the shaft 22 and the center of the base 30. Through its conical form, the latter at the same time forms a seat for an elastic valve such as the valve 17 in FIGS. 3 and 4, if applicable. In this variant, the length of the plunger tube 14 may be limited by the presence of the shaft 22, and this latter, although projecting below the base 30, is protected by the prolongation of the side wall of the container body 15 below the base 30.

Other embodiments of the base are possible without departing from the scope of the invention.

It also does not go outside the scope of the invention to form the container 15 in one piece for packaging small volumes of a product, since in this case the diameter of the container is small and allows a pump to be attached directly to the body of the container.

When the diameters of the container body are larger and do not allow the pump to be attached directly to the body, the addition of an intermediate part such as a linking ring between the pump and the body to allow the pump to be attached is a means equivalent to adding a neck such as 15*a* to a body such as 15*b* of the container.

What is claimed is:

1. A device for packaging and dispensing a product comprising:

a rigid container for containing the product to be packaged and dispensed;

a manual pump mounted on the container for dispensing the product in unit doses;

a filter for filtering the outside air entering the container when the pump is actuated wherein the pump has no air intake in the container and the filter is arranged in an air intake passage provided in the base of the container; and a valve for preventing any leakage of the product contained in the container through the air intake passage wherein the valve is elastically deformable and cooperates with a seat, on or in a shaft integrated with the base and delimiting the air intake passage, and in which the filter is retained.

2. The device according to claim 1, wherein the container is formed in two parts, one of which is a neck with an open mouth on which the pump is mounted with a sealing means, and the other is a body the base of which includes the air intake passage which houses the filter, the two parts being injection-molded separately and assembled in a sealed manner.

3. The device according to claim 1, wherein the elastically deformable valve is retained by a plug on or in the shaft.

4. The device according to claim 1, wherein the air intake passage includes grooves provided in the plug, in the seat or in the wall of an orifice in which the plug for fixing the valve on the shaft is retained.

5. The device according to claim 1, wherein the filter is mounted in a rigid sheath the outer form of which matches that of a part of the air intake passage and in which the sheath is fixed by press-fitting, ultrasonic welding or snap-fitting.

6. The device according to claim 1, wherein the filter is mounted on a conical central part of a shaft formed in one piece with the base of the container.

7. The device according to claim 1, wherein the air intake passage ends, toward the inside of the container at the central part of a conical base of the container, said base widening towards the inside of the container so as to permit better emptying of the container.

8. The device according to claim 1, wherein the valve is arranged between the filter and the internal space of the container to prevent any contact between the product and the filter.

9. The device according to claim 1, wherein the filter is arranged between the valve and the internal space of the container to prevent any contact between the product and the valve.

10. The device according to claim 1, wherein the base of the container is injection-molded in a synthetic material.

11. A device for packaging and dispensing a product comprising:

a rigid container for containing the product to be packaged and dispensed;

a manual pump mounted on the container for dispensing the product in unit doses;

a filter for filtering the outside air entering the container when the pump is actuated wherein the pump has no air intake in the container and the filter is arranged in an air intake passage provided in the base of the container; and wherein the filter is mounted in a rigid sheath on a conical central part of a shaft formed in one piece with the base of the container, the outer form of the rigid sheath matches part of the air intake passage and in which the rigid sheath is fixed by press-fitting, ultrasonic welding or snap-fitting.

12. The device according to claim 11, further comprising a valve for preventing any leakage of the product contained in the container through the air intake passage.

13. The device according to claim 12, wherein the valve is arranged between the filter and the internal space of the container to prevent any contact between the product and the filter.

14. The device according to claim 12, wherein the filter is arranged between the valve and the internal space of the container to prevent any contact between the product and the valve.

15. The device according to claim 11, wherein the conical central part of the shaft is closed towards the outside of the container by a base in which an eccentric hole of the air intake passage is provided.

16. The device according to claim 11, wherein the base of the container is injection-molded in a synthetic material.

17. The device according to claim 11, wherein the container is formed in two parts, one of which is a neck with an open mouth on which the pump is mounted with a sealing means, and the other is a body the base of which includes the air intake passage which houses the filter, the two parts being injection-molded separately and assembled in a sealed manner.

* * * * *

UNITED STATES PATENT AND TRADEMARK OFFICE

CERTIFICATE OF CORRECTION

PATENT NO. : 6,354,469 B1
DATED : March 12, 2002
INVENTOR(S) : Pozzi J.

Figure 8:
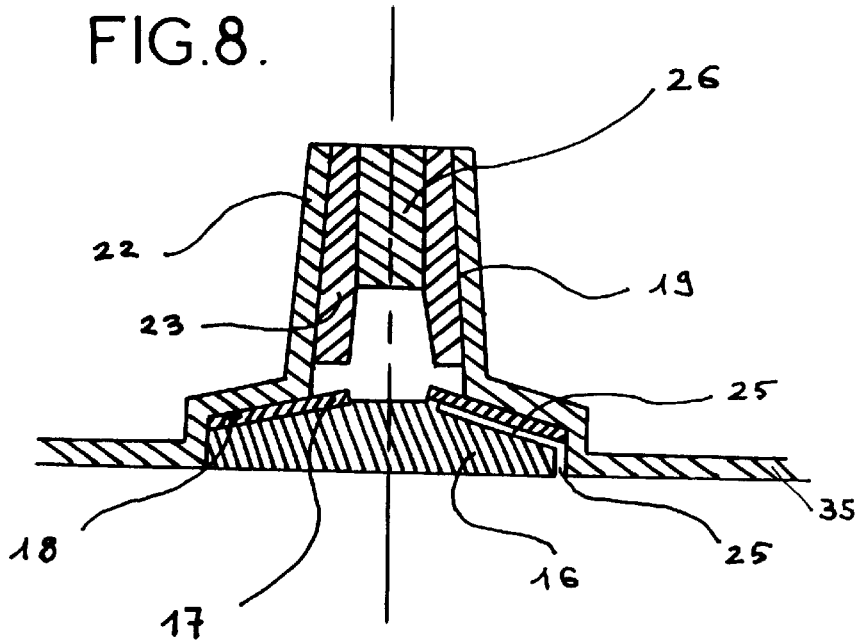
FIG. 8 is a view analogous to FIG. 3 showing yet another variant, with the filter arranged between the valve and the product in the container.

It is certified that error appears in the above-identified patent and that said Letters Patent is hereby corrected as shown below:

Column 8,
Between lines 56 and 57, insert the following:

-- In Fig. 8, the shaft 22 at the center of the base 35 of the container 15b has a single wall formed by three successive tubular sections, the lower tube, slightly tapered or cylindrical, being formed in one piece with the base 35, the upper tapered tube (towards the inside of the container) forming the female conical part 19 delimiting the air intake passage and housing the filter 26 in its sheath 23, while the intermediate tapered tube is very flared towards the outside underneath the base of the container. The lower tube and the intermediate tube thus enclose a housing in which is fitted the plug 16 holding the elastic membrane valve 17 against the tapered seat 18 formed by the lower face of the tapered intermediate tube.

Grooves 25 forming air passages are provided laterally in the plug 16 and end below the upper and central face of the valve 17, which is elastically deformed towards the inside of the shaft 22 through the suction cause by a partial vacuum created in the container when the pump 13 is operated, so as to admit outside air to the container through the filter 26 which, in this variant, is arranged between the valve 17 and the product in the container.

This variant has the following advantages. It avoids the valve 17 being in contact with the product located in the container when the chemical nature of the valve 17 is incompatible with that of the product. This variant also allows the filter 26 and the sheath 23 to be blocked by the plug 16 so that the filter 26 and/or the sheath 23 do not escape towards the outside of the shaft 22. The filter 26 is protected from any outside physical attack which might impair its integrityor its good functioning. Finally, this variant improves the appearance of the container by concealing the presence of the filter 26. --

Signed and Sealed this

Ninth Day of July, 2002

*Attest:*

*Attesting Officer*

JAMES E. ROGAN
*Director of the United States Patent and Trademark Office*